United States Patent [19]

Fourie et al.

[11] Patent Number: 4,614,277

[45] Date of Patent: Sep. 30, 1986

[54] PALLET WITH TENSIONED STRIPS AND BULK BIN

[75] Inventors: Gideon Fourie, King Williamstown; David E. Muir, Pinelands, both of South Africa

[73] Assignee: South African Inventions Development Corporation, Pretoria, South Africa

[21] Appl. No.: 736,677

[22] Filed: May 22, 1985

[30] Foreign Application Priority Data

May 22, 1984 [ZA] South Africa ..... 84/3858
Jul. 17, 1984 [ZA] South Africa ..... 84/5515

[51] Int. Cl.[4] ..... B65D 19/31

[52] U.S. Cl. ..... 217/43 A; 108/51.1; 144/349; 206/386

[58] Field of Search ..... 206/386, 599; 217/43 A; 108/51.1, 51.3, 5.21, 54.1, 55.1, 55.3, 55.5; 144/349, 353; 156/160, 163

[56] References Cited

U.S. PATENT DOCUMENTS 2,649,124 8/1953 Merron ..... 144/349
3,207,096 9/1965 Munroe ..... 108/51.1
3,294,608 12/1966 Peterson ..... 156/160
4,060,037 11/1977 Gustafsson ..... 108/55.1
4,426,015 1/1984 Preston et al. ..... 206/386
4,442,149 4/1984 Bennett ..... 144/349

FOREIGN PATENT DOCUMENTS 1593083 7/1981 United Kingdom ..... 206/599
2100666 1/1983 United Kingdom ..... 108/51.1

*Primary Examiner*—William Price
*Assistant Examiner*—Gary E. Elkins
*Attorney, Agent, or Firm*—Dressler, Goldsmith, Shore, Sutker & Milnamow

[57] ABSTRACT

A pallet (10) comprising a top deck consisting of planks (20, 22, 24, 26) to the undersides of which blocks (28, 30, 32) are secured. The entire pallet is deformed to a convex form so that its length and width are reduced with respect to its undeformed dimensions. The lower faces of the blocks are joined by chordally extending strip material (18) which is tensioned by the pallet. Tensioning of the strips (18) ensures that these lie flat on the floor out of the way of the tines of a forklift truck when these are inserted below the planks to lift the pallet.

10 Claims, 5 Drawing Figures

PALLET WITH TENSIONED STRIPS AND BULK BIN

This invention relates to pallets and to bulk bins for shipping produce such as apples.

BACKGROUND TO THE INVENTION

When using standard size international shipping containers it is important to ensure that as much as possible of the space within the container is filled with the commodity being shipped. This is because, provided a maximum mass limit is not exceeded, the cost of shipping a container is calculated on the basis of volume and not mass.

Palletized loads pose particular problems. The pallet must have a sufficient gap between its upper and lower decks to permit the forks of a forklift truck to pass between them. If the load is in boxes, and the overall height of the pallet and a particular number of layers of boxes exceeds the height of the container by even the smallest amount, then the top layer of boxes must be removed and space is consequently wasted in the top of the container.

OBJECTS OF THE INVENTION

The main object of the present invention is to provide a method of manufacturing a pallet the overall height of which is less than that of conventional wooden pallets.

BRIEF SUMMARY OF THE INVENTION

According to one aspect of the present invention there is provided a method of manufacturing a pallet which method comprises constructing a frame consisting of planks secured to spacer elements, inverting the frame and exerting forces on the frame so as to deform the frame into a dish-like form thereby reducing both its overall length and its overall width, joining the spacer elements to one another by means of tensionable material, the material extending chordally across the deformed frame, and removing the deforming forces from the frame so that it straightens and exerts tensioning forces on said material, said planks, spacer elements and material defining laterally open entrances for the tines of a forklift truck.

The material is desirably in the form of strips extending between said spacer elements but could be in the form of a single sheet.

Because the material attached to the spacer elements is under tension it lies flat on the floor and the chances of the tines of a forklift truck passing under it and damaging it are far less.

The preferred material is laminated paper but could be metal in wire or strip form.

According to a further aspect of the present invention there is provided a pallet comprising a load carrying frame composed of planks and spacer elements, said planks being connected to top faces of said spacer elements, and tensionable material being secured to the spacer elements and extending between the spacer elements, the frame being deformed to a convex shape prior to said material being attached so that its overall length and overall width are both reduced with respect to its undeformed dimensions, and said material extending chordally with respect to the frame between the spacer elements, said frame, in tending to return to its initial planar condition, exerting forces on said material which tensions it.

DETAILED DESCRIPTION OF THE INVENTION

For a better understanding of the present invention, and to show how the same may be carried into effect, reference will now be made, by way of example, to the accompanying drawings in which.

Figure 1:
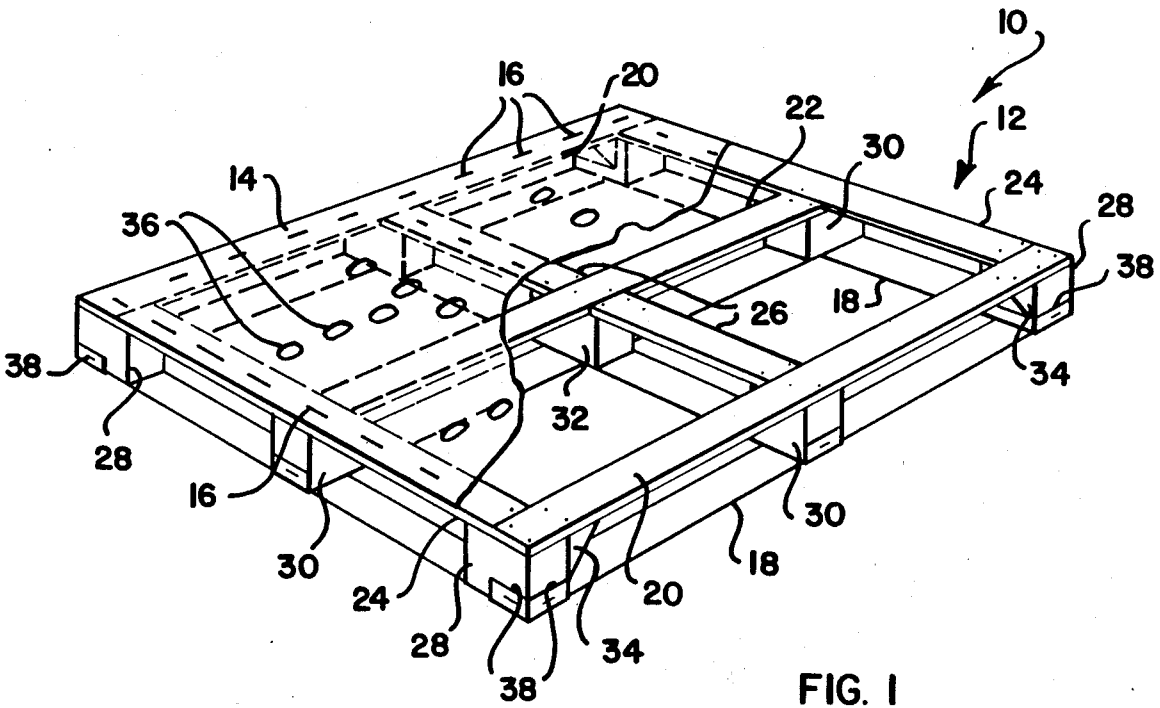
FIG. 1 is a pictorial view of a pallet, part of a top sheet being omitted to show the underlying construction.
Figure 3:
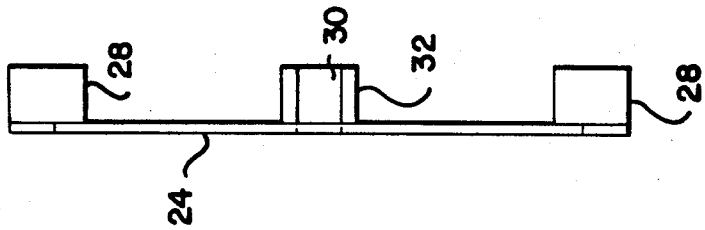
FIGS. 3 and 4 are an end elevation and a side elevation respectively of the pallet frame of FIG. 2.
Figure 2:
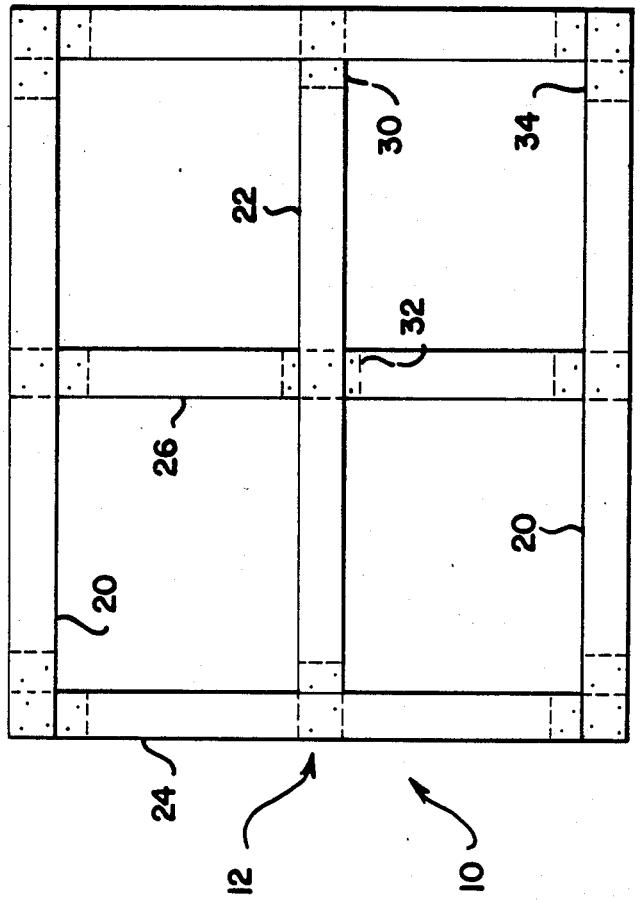
FIG. 2 is a top plan view of a pallet frame.
Figure 4:
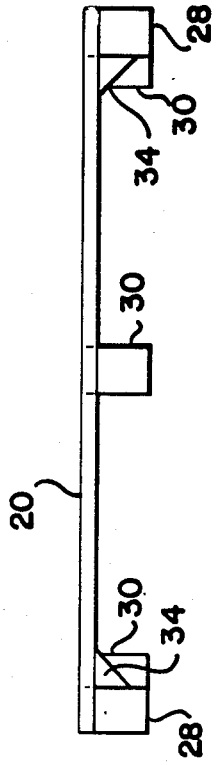

Referring firstly to FIG. 1, the pallet illustrated is generally designated 10 and comprises a wooden frame 12, a load supporting sheet 14 secured by staples 16 to the frame 12, and strips 18 secured to the underside of the frame 12.

The frame 12 comprises two full length parallel longitudinal planks 20, an intermediate longitudinal plank 22, two full-width transverse planks 24 and two short transverse planks 26. The frame 12 also consists of four corner blocks designated 28, four edge blocks 30 and a centre block 32.

The ends of the planks 20 and 24 are nailed, screwed, stapled or secured in any other suitable way to the corner blocks 28. Each corner block 28 is extended by a strengthening gusset 34 of triangular shape, the gussets being attached to the sides of the main parts of the blocks and to the undersides of the planks 20.

The blocks 30 are secured to the planks 20, 24 intermediate their ends and the planks 22, 26 are secured to the parts of the blocks 30 which protrude inwardly from the planks 20, 24. The other ends of the planks 26, and the plank 22 intermediate its ends, are secured to the block 32.

The load supporting sheet 14 is secured by the staples 16 to all the planks 20, 22, 24 and 26 and is formed with ventilation apertures 36. The sheet 14 is preferably of the material which is known as 'slip sheet' material and which consists of a number of layers of paper laminated to one another. Such material has been used to support non-palletized but bound loads. Corrugated board, sheet synthetic plastics material or synthetic plastics material mesh can also be used.

These materials have little inherent rigidity. A strip of any of these materials held at one end will not extend horizontally but will curve down under its own mass.

The blocks 28, 30 and 32 are joined by the strips designated 18 which are of the same material as the sheet 14. Each of the four outer strips 18 passes beneath an edge block 30 and is secured thereto by stapling and/or glueing. The ends of these strips 18 pass beneath the corner blocks 28 and then turn upwardly to form portions 38. Both the portions 38 and the parts of the strips 18 which lie below the blocks 28 are secured to the blocks 28. The cross strips 18 are, intermediate their ends, secured to the underside of the block 32 and their ends are secured to the blocks 30 in the same way that the ends of the other strips 18 are secured to the blocks 28. It will be noted that the strips 18 are thinner than the planks 22 etc. Thus the overall height of a pallet including strips 18 is substantially less than that of a pallet including wooden planks below the blocks as well as above them.

Figure 5:
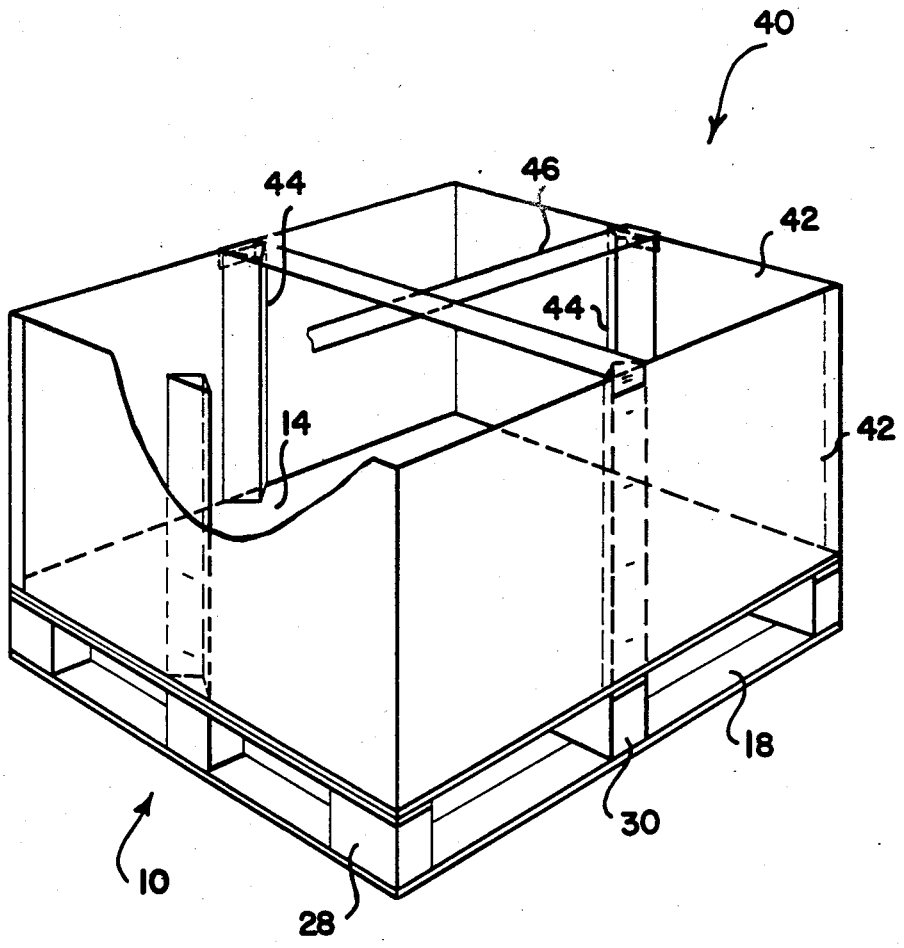
FIG. 5 is a pictorial view of a bulk bin.

Referring now to FIG. 5, the bulk bin illustrated is designated 40 and has four side walls 42 secured, for example by glueing and stapling, to the edges of the pallet. The side walls consist of sheets of corrugated fibreboard, laminated paper or other flexible material which is capable of withstanding the forces exerted thereon by a load of, for example, apples in the bin without bursting. The four walls can be constituted by a single sheet of material, the sheet being formed with four vertical bends and the vertical end portions thereof being overlapped and secured together to form a vertical seam. To facilitate production, two sheets of material can be used instead of a single sheet. The two sheets are secured together end-to-end, each of them constituting two of the walls of the bin.

To provide additional bursting resistance, each wall can be of double thickness and can consist of inner and outer components. The walls may be treated with waterproofing additives.

It is also possible to strengthen the base of the bulk bin by providing a flap along the lower edge of each wall 42, the flaps extending horizontally inwardly from the respective walls and overlying the sheet 14. Alternatively, it is possible to provide a shallow tray which is suitably secured to the pallet. The base of the tray overlies the slip sheet 14 and the lower edges of the walls 42 are suitably secured to the low height walls which bound the base of the tray.

In the construction just described the tray base or horizontal panels are suitably apertured to provide ventilation.

Four or more posts 44 are secured to the pallet 10. Where there are four posts 44, each lies mid-way between the ends of a respective wall 42. Where there are more than four posts 44, they are evenly spaced along the walls. The posts are glued and/or stapled to the walls 42 and to the sheet 14. Opposed posts are joined to one another by strips 46 of a laminated paper material such as that which is used to form the so-called slip sheet of an unpalletized load. It will be noted that the ends of the strips 46 are bent downwardly to form vertical portions and these are secured to the outside of the respective wall 42 by glueing or stapling or in any other suitable manner.

Prior to attaching the strips 18 to the blocks 28, 30 and 32 during construction of the pallet, the frame 12 is inverted from the position illustrated in FIG. 1 and the centre block 32 forced downwardly with respect to the blocks 28 and 30 thereby to distort the frame 12. Alternatively, the block 32 can be held still and the outer edges of the frame forced upwardly. The planks are thus bowed and the frame 12 takes on a shallow concave form. Both the overall width of the frame 12 and its overall length (both measured horizontally) are thus reduced somewhat. The strips 18 are then attached.

When the distorting forces are removed, the frame 12 tends to straighten, and this tensions the strips 18.

The degree to which the frame 12 is distorted, and the length chosen for the strips 18, are such that the frame, even after being allowed to return towards its initial condition, remains slightly bowed so that the strips are continually under tension. When the bulk bin is loaded, the mass of the produce placed therein flattens the frame 12 and further tensions the strips 18.

It will be understood that when the bulk bin is handled by a mechanical lifting device such as a fork-lift truck, the lifing tines of the truck enter the space between the planks 20, 24 and the strips 18. The tensioning of the strips 18 keeps them flat and thus the possibility of the tines of the truck damaging them is small.

Laminated paper is the preferred material for the sheet 14, strips 18 and strips 46. However, as mentioned above, any material of sufficiently high tensile strength which can be produced in sheet form can be used. Where laminated paper is used it can be resin coated so that it is moisture resistant.

The sheet 14 can, if desired, be replaced by a plurality of strips of material.

We claim:

1. A method of manufacturing a pallet which method comprises constructing a frame consisting of planks secured to spacer elements on one side of the planks, exerting forces on the frame so as to deform the frame into a dish-like form thereby reducing both its overall length and its overall width, joining the spacer elements to one another by means of tensionable material, the material extending chordally across the deformed frame, and removing the deforming forces from the frame so that it straightens and exerts tensioning forces on said material, said planks, spacer elements and material defining laterally open entrances for the tines of a forklift truck.

2. A method as claimed in claim 1, wherein said material is in the form of strips extending between said spacer elements.

3. A method as claimed in claim 1, wherein said material is laminated paper.

4. A pallet comprising a load carrying frame composed of planks and spacer elements, said planks being connected to top faces of said spacer elements, and tensionable material being secured to the spacer elements and extending between the spacer elements, the frame being deformed to a convex shape prior to said material being attached so that its overall length and overall width are both reduced with respect to its undeformed dimensions, and said material extending chordally with respect to the frame between the spacer elements, said frame, in tending to return to its initial planar condition, exerting forces on said material which tensions it.

5. A pallet as claimed in claim 4, wherein said material is in the form of strips extending between said spacer elements.

6. A pallet as claimed in claim 4, wherein said planks are of wood and said spacer elements are in the form of wooden blocks.

7. A pallet as claimed in claim 4 or 6, wherein said material is laminated paper.

8. A pallet as claimed in claim 6, wherein said material is metal in wire or strip form.

9. A pallet as claimed in claim 4, wherein a sheet of laminated paper is secured to said planks on sides thereof remote from said spacer elements.

10. A bulk bin consisting of a pallet as claimed in claim 4, and vertically extending flexible side walls attached to said pallet, there being, between ends of the side walls, opposed supporting posts which are attached to said side walls, upper end regions of said opposed posts being connected to one another by strips of material.

* * * * *

UNITED STATES PATENT AND TRADEMARK OFFICE

CERTIFICATE OF CORRECTION

PATENT NO. : 4,614,277

DATED : September 30, 1986

INVENTOR(S) : Gideon Fourie and David E. Muir

It is certified that error appears in the above-identified patent and that said Letters Patent is hereby corrected as shown below:

Column 1, line 35, after "elements" insert --on one side of the planks--

Signed and Sealed this

Tenth Day of February, 1987

*Attest:*

DONALD J. QUIGG

*Attesting Officer*

*Commissioner of Patents and Trademarks*